United States Patent [19]

Nicolay

[11] 4,116,145

[45] Sep. 26, 1978

[54] UPPER FABRIC FEED DEVICE FOR SEWING MACHINES

[75] Inventor: Karl Nicolay, Bielefeld, Germany

[73] Assignee: Durkoppwerke GmbH, Bielefeld, Germany

[21] Appl. No.: 793,415

[22] Filed: May 3, 1977

[30] Foreign Application Priority Data

May 7, 1976 [DE] Fed. Rep. of Germany ..... 2620209

[51] Int. Cl.[2] ..... D05B 27/04

[52] U.S. Cl. ..... 112/212

[58] Field of Search ..... 112/212, 207, 203, 213

[56] References Cited

U.S. PATENT DOCUMENTS

| | | | |
|---|---|---|---|
| 2,339,240 | 1/1944 | Clayton | 112/207 |
| 2,470,759 | 5/1949 | Clayton | 112/212 |
| 3,935,826 | 2/1976 | Nicolay et al. | 112/212 |

*Primary Examiner*—Peter Nerbun

*Attorney, Agent, or Firm*—Karl F. Ross

[57] ABSTRACT

A fabric-transport device for a sewing machine above the stitch plate converts the rotary motion of the main upper drive shaft into reciprocating vertical motion of a pressure (hold-down) foot and a feed foot. The rotary motion is converted by a crank disc connected to a bell crank via an input crank. The bell crank swings a composite connecting rod, comprising a sliding link which interconnects the bell crank with a ternary link carrying the feet and comprising a guide bar for guiding the sliding link. The ternary link is spring-loaded against the stitch plate by a swingable arm and alternatingly lifts the pressure foot and the feed foot. The system provides for fast reduction of the velocity, towards zero velocity, of the feet as they depress to engage with the material to be sewn.

9 Claims, 4 Drawing Figures

UPPER FABRIC FEED DEVICE FOR SEWING MACHINES su

FIELD OF THE INVENTION

This invention relates to a feeding arrangement above the work table or stitch plate of a sewing machine for advancing or feeding of material to be sewn. More particularly, this invention is concerned with improved means for converting and transmitting motive power from the upper main drive shaft of the sewing machine to a pressure (hold-down) foot and feed foot, respectively.

BACKGROUND OF THE INVENTION

A feeding arrangement, especially suited for high-speed industrial sewing machines, comprising a pressure foot and a feed foot, is known (see U.S. Pat. No. 3,935,826, issued Feb. 3, 1976) in which the feed foot and the hold-down foot are alternatingly brought into feeding or advancing contact with the material to be advanced in the sewing machine. The feet are vertically moved, in reciprocating motion, by means of a bell-crank lever which is eccentrically actuated and the bell-crank lever, in turn, actuates a ternary link.

In the system of the patent, a particular transmission arrangement or assembly or linkage system is employed, this system being disposed between the eccentric actuator of the bell crank and the feet engaging the workpiece to be transported or advanced by the feeding mechanism, which will ensure decrease, towards zero, of the velocity of the feet in their respective downward-motion as they reach their lower limiting positions.

For the transmission assembly or linkage system, means comprising cam or crank-actuated transmissions or combinations of both types of transmission can be utilized.

In practice, the transport of material of varying thickness is of considerable difficulty because such variations will require a constant pressure adjustment by the transporting feet, the attendant linkages and transmission means.

Thus the system of the patent comprises four major kinematic elements or components, namely, a ternary link or rocker in the form of a bell-crank lever fulcrummed on a fixed portion of the machine housing and having one arm articulated to a crank arm, a binary link articulated at one end to the other arm of the ternary link, a lever swingably connected at one end to the upper member of a vertically displaceable and spring-loaded frame forming a guide for the presser or hold-down foot (the binary link being connected pivotally to an intermediate location of the latter lever), and a further ternary link of triangular configuration pivotally connected at one vertex to the lower end of the latter lever, pivotally connected at another vertex to the presser or hold-down foot, and pivotally connected at the third vertex to the feed foot. These elements perform primarily swinging or rocking or oscillating motion rather than complete rotations, i.e. rotations of multiples of 360°. This arrangement must be made responsive to variations in thickness of the material to be sewn. Thus, in this prior-art arrangement the vertically shiftable frame is employed to provide for the required adjustment.

This will result in difficulties, however, due to limitations in space and due to complexities of the various moving elements in the sewing machine arm.

The feed foot is guided in an arm swingable on the machine housing and adapted to laterally displace the feed foot and advance the fabric. Thus, while the presser or hold-down foot only undergoes vertical movement, the feed foot can undergo both vertical and lateral (fabric-feeding) movement.

OBJECTS OF THE INVENTION

It is therefore an object of the present invention to provide an improved feed mechanism for feeding material in a sewing machine.

Another object of the present invention is to provide an assembly for transmitting motive power to a feed foot and pressure foot, respectively, in a sewing machine, which assembly is compact and of relatively light-weight design.

Another object of the present invention is to provide a transmission assembly for operating a feed foot and a pressure foot which will be responsive to varying thickness of the material that is to be sewn.

Yet another object of the present invention is the provision of a feed mechanism that can be successfully employed at high operating speeds of a sewing machine.

Still another object of the present invention is the provision of a feed assembly which is readily installed and serviced.

An important object of the invention is to provide a system utilizing advantages of U.S. Pat. No. 3,935,826 but which eliminates disadvantages of the aforementioned frame, both with respect to structural and spatial considerations, and substitutes an improved arrangement enabling adjustment of the device to varying fabric thicknesses.

SUMMARY OF THE INVENTION

These objects are attained by eliminating the frame of the system of the aforementioned patent and swingably mounting the triangular link or lever, instead, upon a spring-biased arm hinged at its end remote from the triangular link upon the machine housing, the spring acting upon this arm with adjustable force to resist upward displacement of the triangular link.

According to a feature of the invention, the driving vertex of the triangular link is connected, by a binary link, to an extensible swing or rocker pivoted to the housing at a first point on one of two relatively slidable members of this rocker. The binary link is articulated to the other member of the composite swing and rocker at a second point while the crank is connected, in turn, to the swing or rocker to actuate the same.

The feet are brought to standstill progressively by progressive approach to coincidence of the aforementioned first and second points.

In accordance with the present invention, a transmission arrangement is provided for converting the rotary motion of the upper main drive shaft of a sewing machine into the reciprocating vertical motion of the pressure foot and the feed foot, respectively. The rotary motion is initially transmitted, by means of an input or drive crank, to a drive wheel or crank disc which will actuate, in eccentric movement, a bell crank mounted on a fixed pivot.

The bell crank thus performs a rocking or swinging motion which is transmitted to the composite connecting link and from thence, by means of an output crank to a ternary link. The ternary link is pressure adjusted by a link having a fixed pivot point which link is maintained under pressure by the force of a compression spring resting with one end centrally on the link. The spring is guided on a guide shaft and terminating with its other end in the upper wall of the sewing machine where provision is made for an adjustment screw for selection of the desired pressure to be exerted on the spring.

According to one feature of the invention, therefore, the composite connecting link comprises a guided sliding link and a guide bar for guiding the sliding link which guide bar has a fixed pivot point. The free arm of the bell crank, hereinafter also referred to as the swing arm of the bell crank, is pivotally attached to one end of the guided sliding link, while the other end of the sliding link is pivotally connected to the output crank which connects the system with the ternary link.

According to yet another feature of the invention, the guide bar is disposed in said guided link to permit pivotal swinging motion of the sliding link with respect to the pivot point of said guide bar.

According to still another feature of the present invention, an equal distance is provided, at zero speed of the transporting feet, by the sum of the effective length of the sliding link plus the length of the swing arm of the bell crank and the sum of the length of the distance from the pivot center of the guide bar to the pivot center of the swing arm with the sliding link plus the length of the swing arm of the bell crank.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
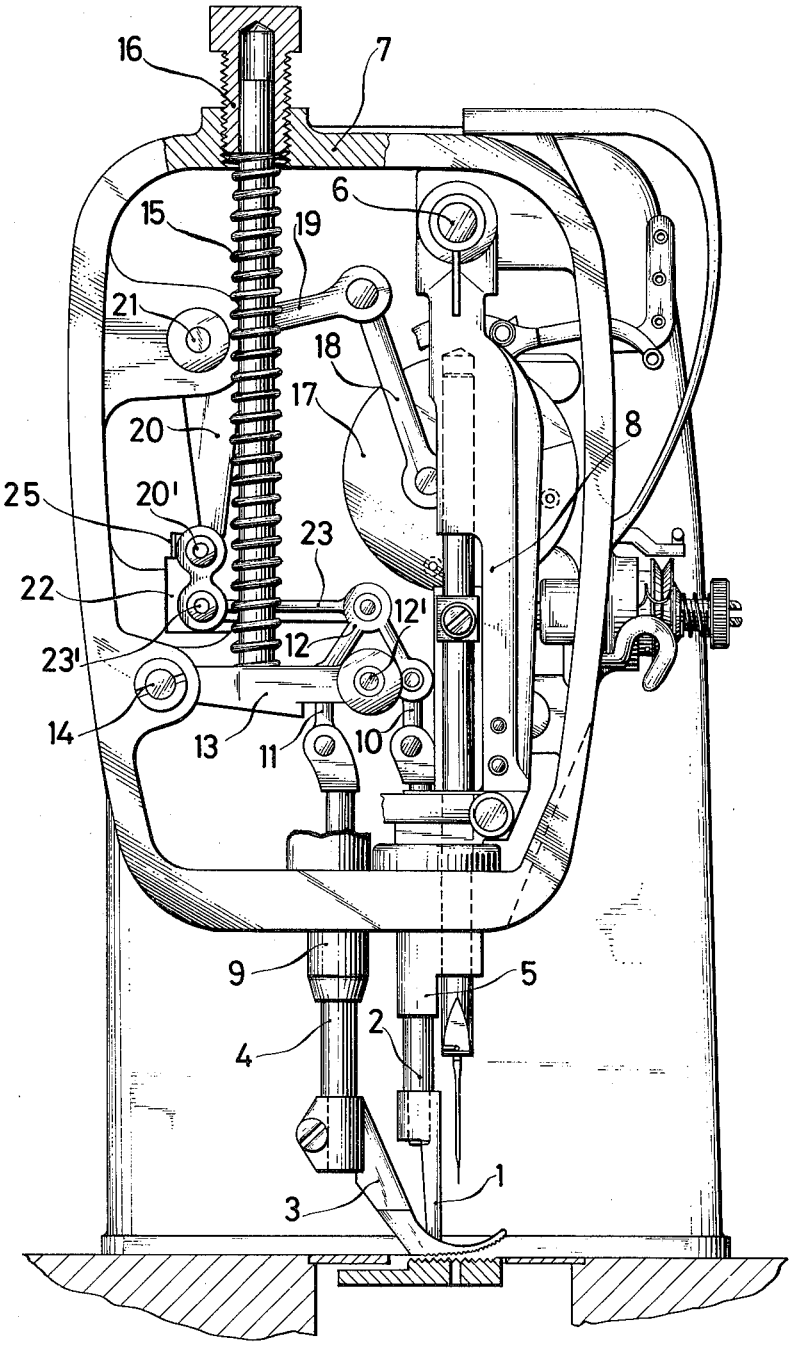
FIG. 1 shows the general arrangement of the upper transport mechanism in the head portion of the sewing machine arm.
Figure 2:
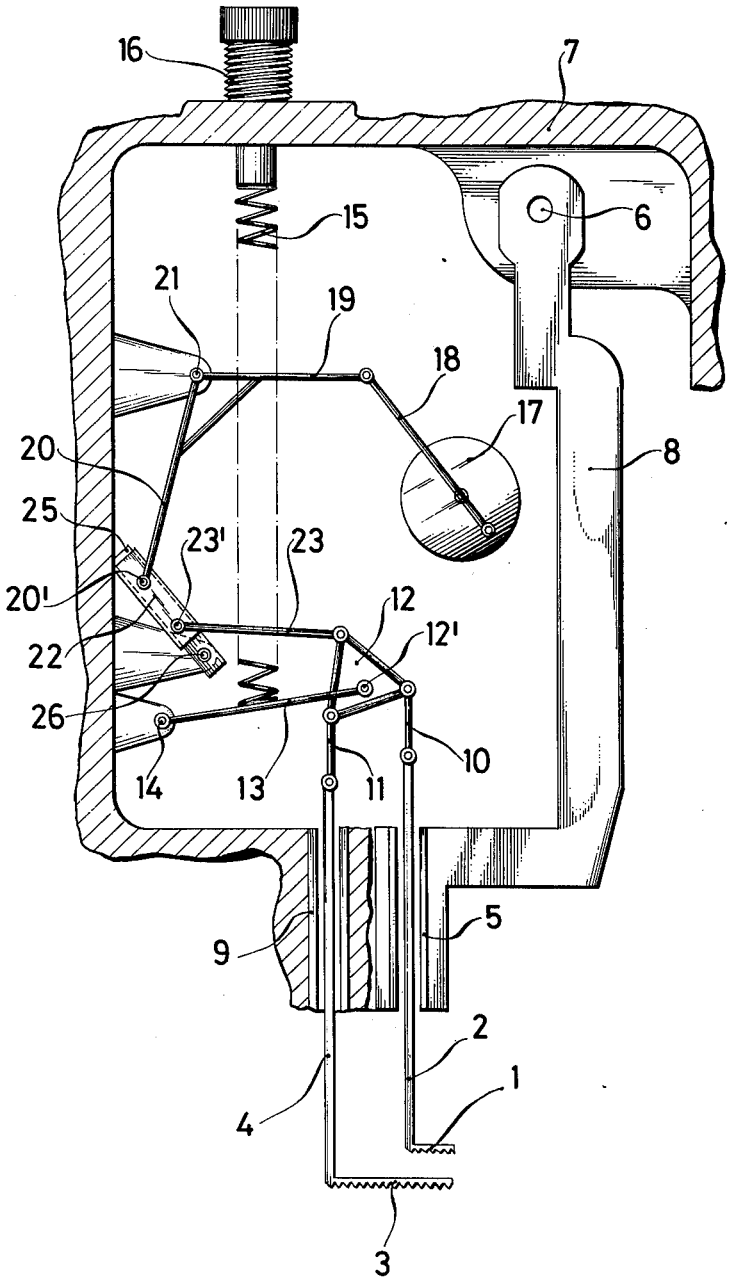
FIG. 2 shows in schematic representation the transport mechanism with the feed foot in raised position.
Figure 3:
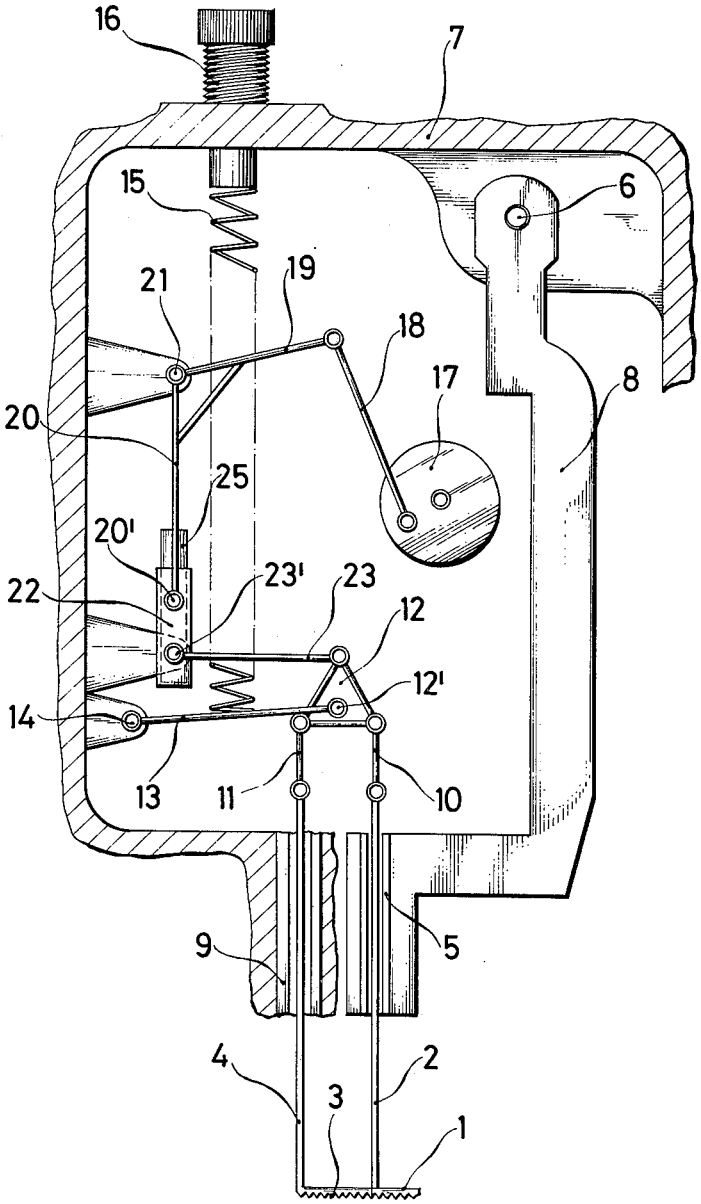
FIG. 3 shows a view similar to FIG. 2 with the feed foot and pressure foot in transporting contact with the material to be sewn.
Figure 4:
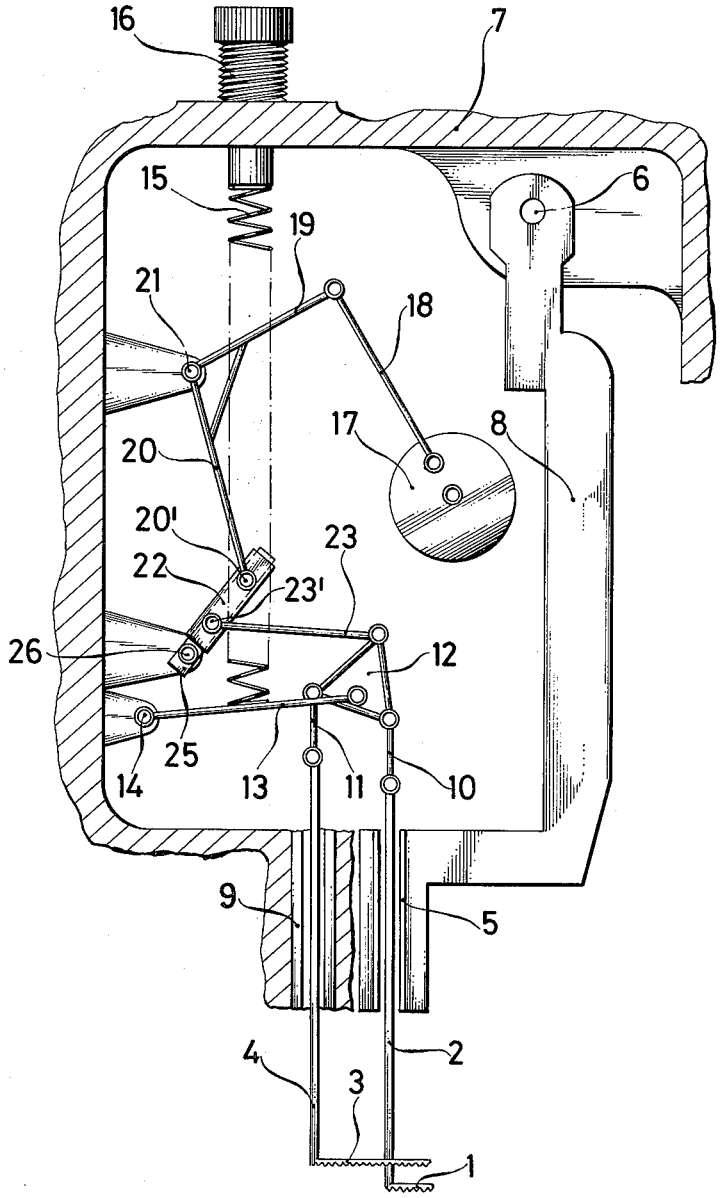
FIG. 4 shows a view similar to FIG. 2 with the pressure foor in raised or lifted position.

FIGS. 2–4 show various operating positions of the structure shown in FIG. 1 in highly stylized, representational diagrammatic form.

In the drawing a feed foot 1 is shown which cooperates with a pressure foot 3. The details of the feet are known from U.S. Pat. No. 3,935,826 and do not form part of the present invention. In general structure and function not described in detail herein are the same as the corresponding structure and function in the patent. Thus, feed foot 1 is attached to the lower end of a vertical rod or shaft 2 while pressure foot 3 is attached or secured to a vertical shaft or rod 4. Rod 2 is guided in a vertical sleeve 5 which is part of a swinging lever 8 which lever 8 is provided with a fixed pivot designated 6 at the upper wall of sewing machine arm 7 as can best be seen in FIG. 1. Lever 8 is actuated as described in the patent, such that feed foot 1 displaced, after engaging with the material to be sewn, in feeding motion in horizontal direction.

Shaft 4 which carries the pressure foot 3 is guided in the lower wall of sewing machine arm 7 by a longitudinal bushing 9 in which the shaft 4 can be vertically moved upwardly and downwardly, alternatingly with the feed foot 1, as will be described further below.

Shaft 2 and shaft 4 are connected at their respective upper ends, by means of short connecting links 10 and 11, to a ternary link 12. The ternary link 12 can be pivoted about pivot center 12 common with a link 13. This link 13 is maintained under the pressure of a spring 15. Spring 15 is a compression spring guided by a guide post or pin in order to avoid sidewise deflection of the spring. The spring is abutting with its upper end against a threaded cap or adjustment screw 16 in the top wall of sewing machine arm 7. Thus, by turning the threaded fastener 16 in a correspondingly threaded hole or bore in the top wall of the sewing machine arm 7, the force of the spring and, therefore, the transport feet pressure can be regulated.

The reciprocating vertical movement of the feed foot 1 and the pressure foot 3, respectively, is produced by a drive system comprising a drive wheel or crank disc 17 driven by the upper drive shaft, not shown, of the sewing machine as is known in the art. To the crank disc 17 an input crank or drive crank is eccentrically attached which, in turn, actuates a bell crank. The bell crank is composed of receiving arm 19 and swing or free arm 20 and the bell crank has a fixed pivot 21.

The free arm 20 of the bell crank is pivotally attached to a sliding link 22 about pivot center 20'. The other end of the sliding link 22 is, in turn, pivotally attached to an output link 23 about pivot center 23'. The sliding link 22 is guided on a guide bar 25 which is provided with a pivot center 26 as can best be seen in FIGS. 2 and 4.

Output link 23 connects the transmission this far described with the ternary link 12 which link 12 carries the pressure foot 3 and the feed foot 1.

In order to achieve the desired reduction of the velocity towards zero of the two feet during the final phases of their respective downward movement, the distance between pivot center 23' and pivot center 26 is continuously reduced until the two centers are congruent, i.e. their axes coincide, as can best be seen in FIG. 3 in which numeral 23' designates the center for pivotal motion of the guide bar 25 and the sliding link 22 (sleeve slidable on the guide bar).

In the position shown in FIG. 3 the distance, measured from the respective pivot centers, from pivot center 21 to 20' plus distance from pivot center 20' to pivot center 23' is equal to the distance from pivot center 26 to pivot center 20' plus distance from pivot center 20' to center 21 or, in other words, these pivot centers are in substantial vertical alignment. In this position of the system the pressure foot 3 and feed foot 1 are in their lowermost or transporting position while the velocity of both feet is momentarily zero.

As is depicted in FIG. 2, the input crank has been displaced by the rotary motion of crank disc 17 in a counter-clockwise direction. Therefore, the arm 19 of the bell crank has been depressed while the swing arm 20 is moved, about pivot center 21, in a clockwise direction. Through this motion, the sliding link 22 is moved such that the distance between the pivot centers 26 and 20' will be greater than the distance between the pivot center 20' and the pivot center 23'. Although the sliding link is displaced on the guide bar 25, the motion of the swing arm 20 will cause the output link 23 to be displaced to the left such that the ternary link 12 is moved about its pivot center 12′ in a counter-clockwise direction and will raise the feed foot 1 away from material while maintaining foot 3 in pressure contact.

Similarly, as is shown in FIG. 4, the input crank 18, due to its eccentricity with respect to the center of the crank disc 17, has now raised the arm 19 of the bell crank and thus caused the swing arm 20 to be displaced to the right of the vertical line indicated in FIG. 3. This movement, in turn, has caused the output link 23 to tilt or move the ternary link 12 about the pivot center 12′ in a clockwise direction so that the pressure foot 3 will be raised while the feed foot 1 will be maintained in pressure contact.

As has been indicated above, the motion of the ternary link 12 is maintained under the tension of the spring 15 which bears on the link 13 between the pivot point 12′ and the fixed pivot point 14. Thus, either foot 1 or 3 is maintained under a relative constant pressure while the other is being raised. Of course, the spring 15 is also effective during the period of time when both feet engage the material to be sewn.

The configuration of the levers, pivot centers and so forth can be of known design, thus, for the pivot centers usual pivot pins and clevises or the like brackets will be provided to permit swinging, rocking and rotating movements of the various elements. The sliding link 22 must be designed so as to permit its movement on the guide bar or rod to a position where the pivot centers 26 and 23′ are completely superimposed.

The transmission system described in the foregoing provides for a swift and accurate conversion of the rotary motion of the main upper drive shaft into the reciprocating up and down motion of the pressure foot and the feed foot. This is achieved by the alignment of four pivot centers, i.e. pivot center 12′ of the bell crank, pivot center 20′ of the swing arm 20 and sliding link 22, pivot center 23′ of the output link 23 and sliding link and pivot center 26 of the guide bar 25, in sliding linear motion with respect to the pivot centers 20′ and 23′, as well as swinging motions about pivot centers 26 and 21. The effective distance, i.e. the distance between the pivot center 20′ and pivot center 26 is greatest as the feet are raised in their respective lifetime motions. At the moment of zero velocity of both feet with respect to their respective downward motions, i.e. when both feet are engaging the material, the effective distance between the pivot centers 21, 20′ and 21, 26 are equal.

I claim:

1. in a sewing machine a transport mechanism comprising a pressure foot and a feed foot for advancing the material to be sewn, the transport transmission which comprises:

a crank disc for transmitting rotary motive power;

an input crank eccentrically connected to said crank disc;

a bell crank actuated by said input crank, said bell crank comprising:

a receiving arm connected to said input crank, a swing arm, and a fixed pivot center for said bell crank disposed between said receiving arm and said swing arm;

a composite connecting link actuated by said swing arm said composite link comprising:

a guide bar having a fixed pivot pin, and a guided sliding link having two pivot centers in fixed relation near its ends;

an output crank actuated by said composite connecting link;

a ternary link carrying on its base the pressure foot and the feed foot;

a further link attached with one end to a fixed pivot center and with its other end pivotally attached to the pivot center of said ternary link; and pressure means for maintaining said further link under a predetermined pressure.

2. The transport transmission defined in claim 1 wherein said sliding link is connected to the swing arm with one of its pivot center and the sliding link is connected with its second pivot center to said output crank.

3. The transport mechanism defined in claim 2 wherein said sliding link is movably arranged with respect to said guide bar such that the pivot center for the output crank on said sliding link and the fixed pivot center of said guide bar have a common axis with the pivot center of said swing arm on said sliding link.

4. The transport mechanism defined in claim 1 wherein said pressure means comprises:

a compression spring;

a guide for said compression spring; and an adjustment screw for varying the tension of the compression spring.

5. The transport transmission defined in claim 4 wherein said compression spring bears on said further link at a point between said fixed pivot center and said pivot center connecting said link with the ternary link.

6. In an apparatus for feeding a workpiece along a surface to a sewing station which comprises:

a hold-down foot and a feed foot reciprocal toward and away from said surface.

means for periodically displacing said feed foot along said surface to advance said workpiece relative to said station; and drive means connected with said feet for alternately advancing same toward said surface with an advance speed decreasing uniformly and continuously until each of said feet comes to a stop atop said workpiece pressing same against said surface, and for alternately displacing said feet away from said surface, said drive means including a triangular lever having a pair of vertexes pivotally connected to the respective feet and a third vertex connected to a crank for actuating said triangular lever, the improvement which comprises:

a first elongated link having a fixed pivot at one end and pivotally connected at its opposite end to said lever; and a spring acting upon said link and yieldably biasing said opposite end in the direction of said surface, said drive means further including:

a bell-crank lever having a first arm articulated to said crank and a second arm;

a composite swing operatively connected to said bell-crank lever for pivotal displacement thereby, said swing including two relatively linearly slidable members, one of said members being swingable about a pivot at a fixed first point; and a further link articulated to the other of said members about a pivot at a second point and pivotally connected to said triangular lever at said third vertex, the axes of the pivots at said first and second points coinciding during the pivotal displacement of said swing about the pivot at said first point.

7. The improvement defined in claim 6 wherein said drive means includes:

a third elongated link articulated to said second arm of said bell-crank lever and to said other member at a location spaced from said second point.

8. The improvement defined in claim 7 wherein said spring is a compression spring bearing upon said first elongated link between the said ends thereof, said improvement comprising further:

means for adjusting the force with which said spring bears upon said first link.

9. In an apparatus for feeding a workpiece along a surface to a sewing station which comprises:

a hold-down foot and a feed foot reciprocal toward and away from said surface;

means for periodically displacing said feed foot along said surface to advance said workpiece relative to said station; and drive means connected with said feet for alternately advancing same toward said surface with an advance speed decreasing uniformly and continuously until each of said feet comes to a stop atop said workpiece pressing same against said surface, and for alternately displacing said feet away from said surface, said drive means including a triangular lever having a pair of vertexes pivotally connected to the respective feet and a third vertex connected to a crank for actuating said triangular lever, the improvement which comprises:

a first elongated link having a fixed pivot at one end and pivotally connected at its opposite end to said lever;

a spring acting upon said link and yieldably biasing said opposite end in the direction of said surface; and a composite swing, having a slider pivotally connected to said crank and through an output link to said third vertex and a linear guide for said slider swingable about a fixed pivot.

* * * * *